US009469440B1

(12) United States Patent
Flood

(10) Patent No.: US 9,469,440 B1
(45) Date of Patent: Oct. 18, 2016

(54) PROTECTIVE POUCH APPARATUS

(71) Applicant: Roberta D. Flood, Arlington, VA (US)

(72) Inventor: Roberta D. Flood, Arlington, VA (US)

( * ) Notice: Subject to any disclaimer, the term of this patent is extended or adjusted under 35 U.S.C. 154(b) by 46 days.

(21) Appl. No.: 14/040,288

(22) Filed: Sep. 27, 2013

Related U.S. Application Data

(60) Provisional application No. 61/713,731, filed on Oct. 15, 2012.

(51) Int. Cl.
*B65D 33/00* (2006.01)

(52) U.S. Cl.
CPC ..... *B65D 33/00* (2013.01)

(58) Field of Classification Search
CPC .. A45C 13/02; A45C 11/20; A45C 213/026; A45C 3/00; B65D 31/04; B65D 33/00
USPC ..... 383/37–40, 109, 110, 113
See application file for complete search history.

(56) References Cited

U.S. PATENT DOCUMENTS

| | | | | |
|---|---|---|---|---|
| 1,839,758 | A | 7/1930 | Hasek | |
| 2,690,199 | A | 9/1954 | Bennorth | |
| 3,066,847 | A | 12/1962 | Fortune | |
| 3,082,713 | A | 3/1963 | Elgin | |
| 3,292,748 | A | 12/1966 | Rifkin | |
| 3,428,104 | A | 2/1969 | Ary | |
| 4,648,121 | A * | 3/1987 | Lowe | 383/76 |
| 4,929,094 | A * | 5/1990 | Becker | 383/7 |
| 2004/0008908 | A1 * | 1/2004 | Shepard | 383/89 |
| 2007/0189639 | A1 * | 8/2007 | Revness | 383/37 |
| 2009/0056279 | A1 * | 3/2009 | Sasaki | 53/449 |
| 2009/0159597 | A1 | 6/2009 | Alexander et al. | |
| 2010/0027920 | A1 | 2/2010 | Raidl et al. | |
| 2014/0270583 | A1 * | 9/2014 | Anderson | 383/37 |

* cited by examiner

*Primary Examiner* — Peter Helvey
(74) *Attorney, Agent, or Firm* — Thomas W. Galvani, P.C.; Thomas W. Galvani

(57) ABSTRACT

A protective pouch apparatus includes an outer pouch having a continuous sidewall with an open end and a closed end. An inner pouch is applied to the outer pouch and includes a continuous sidewall with an open end and a closed end. The outer pouch is constructed of a material having a water-resistant and a fire-resistant material characteristic, and the inner pouch is constructed of a fabric having an insulative material characteristic. Seams are formed in the sidewalls of each of the inner and outer pouches between the respective open and closed ends. When the inner pouch is applied to the outer pouch such that the inner pouch is nested within the outer pouch, the seam in the inner pouch is offset from the seam in the outer pouch.

3 Claims, 11 Drawing Sheets

PROTECTIVE POUCH APPARATUS

CROSS-REFERENCE TO RELATED APPLICATIONS

This application claims the benefit of U.S. Provisional Application No. 61/713,731, filed Oct. 15, 2012, which is hereby incorporated by reference.

FIELD OF THE INVENTION

The present invention relates generally to archival equipment, and more particularly to fire, heat, and water protective apparatuses.

BACKGROUND OF THE INVENTION

House fires cause huge amounts of damage every year. Fires produce devastating flames and intense heat, both of which can consume personal and real property in a matter of minutes. The water used by fire fighters, or disbursed by installed sprinkler systems, is meant to quench both the flame and the heat, but a large volume of water is generally necessary to do so. Because of this, property which is not burned in the fire or the heat is often ruined or severely damaged in the fire-fighting efforts.

Real property, and much personal property, can often be replaced through fire insurance. However, items such as photographs, scrapbooks, home videos, official documents such as wills, trusts, deeds, passports, and the like, have important or sentimental value that cannot be determined or recovered. These can be the greatest losses in a house fire. It is important to constantly protect such items, because fires occur without warning. Many safes protect against fires, but safes are expensive, heavy, bulky, and have a finite storage volume. Moreover, safes can be difficult to unlock and open, reducing the likelihood that the safes' contents are frequently accessed and appreciated. A versatile system for storing and archiving sentimental and other important items is needed.

SUMMARY OF THE INVENTION

According to the principle of the invention, a protective apparatus includes an outer pouch with a continuous sidewall formed of two flexible layers, the outer pouch having an open end and an opposed closed end, and a flat, rectangular profile with opposed first and second sides extending between the open and closed ends. An inner pouch is removably applied to the outer pouch, the inner pouch is configured to nestle articles, and the inner pouch includes a continuous sidewall with an open end, an opposed closed end, opposed first and second sides, and a flat, rectangular profile with opposed first and second faces. The outer pouch is constructed of a material having a water-resistant and a fire-resistant material characteristic, and the inner pouch is constructed of a fabric having an insulative material characteristic. A seam is formed in the sidewall of the outer pouch, and a seam is formed in the sidewall of the inner pouch. When the inner pouch is applied to the outer pouch such that the rectangular profile of the inner pouch is nested within the rectangular profile of the outer pouch, the seam in the inner pouch is offset from the seam in the outer pouch. The inner and outer pouches correspond in width. The outer pouch includes opposed first and second faces, and an engagement assembly carried on the outer pouch. A first engagement element of the engagement assembly is carried on the first face of the outer pouch at a location intermediate with respect to the open and closed ends of the outer pouch, and a second engagement element of the engagement assembly is carried on the second face of the outer pouch proximate to the open end of the outer pouch. The outer pouch has a major length extending between the closed and open ends of the outer pouch, and the outer pouch has a minor length extending between the closed end of the outer pouch and the first engagement element of the engagement assembly. The inner pouch has a length extending between the closed and open ends of the inner pouch, and the length of the inner pouch corresponds to the minor length of the outer pouch. The first engagement element has a length aligned between the open and closed ends, and the second engagement element has a length aligned between the open and closed ends, which is equal to the length of the first engagement element. The first and second engagement elements are spaced apart by a distance equal to the lengths of the first and second engagement elements. In some embodiments, the inner pouch includes a plurality of pockets formed in the inner pouch between the first and second sides, the pockets each having openings proximate to the open end of the inner pouch. Further, in those embodiments, the inner pouch has an extension of the second face forming a flap with opposed ends and a lip, the flap is applied over the open end of the inner pouch and the ends are secured to the first and second sides of the inner pouch on the first face of the inner pouch. The flap is adjustable between a first position, in which the lip is applied against the pockets between the openings of the pockets and the closed end of the inner pouch closing the openings of the pockets, and a second position, in which the lip is away from the pockets and the openings of the pockets are each accessible. The flap is biased into the first position.

According to the principle of the invention, a protective apparatus includes an outer pouch with a continuous sidewall formed of two flexible layers, an open end, an opposed closed end, and a flat, rectangular profile with opposed top and bottom faces extending between the open and closed ends and between opposed first and second sides. An inner pouch is removably applied to the outer pouch, the inner pouch is configured to nestle articles, and the inner pouch includes a continuous sidewall with an open end, an opposed closed end, opposed first and second sides, and a flat, rectangular profile with opposed first and second faces. The outer pouch is constructed of a material having a water-resistant and a fire-resistant material characteristic. The inner pouch is constructed of a fabric having an insulative material characteristic. A seam is formed along the top face of the outer pouch between the open and closed ends of the outer pouch. A seam is formed along the first side of the inner pouch between the open and closed ends of the inner pouch. When the inner pouch is applied to the outer pouch such that the rectangular profile of the inner pouch is nested within the rectangular profile of the outer pouch, the seam in the inner pouch is offset from the seam in the outer pouch. The inner and outer pouches correspond in width. An engagement assembly is carried on the outer pouch, a first engagement element of the engagement assembly is carried on the top face of the outer pouch at a location intermediate with respect to the open and closed ends of the outer pouch and a complemental second engagement element of the engagement assembly carried on the bottom face of the outer pouch proximate to the open end of the outer pouch. The outer pouch has a major length extending between the closed and open ends of the outer pouch, and a minor length extending between the closed end of the outer pouch and the first engagement element of the engagement assembly. The inner pouch has a length extending between the closed and open ends of the inner pouch, and the length of the inner pouch corresponds to the minor length of the outer pouch. The first engagement element has a length aligned between the open and closed ends, the second engagement element has a length aligned between the open and closed ends, which is equal to the length of the first engagement element, and the first and second engagement elements are spaced apart by a distance equal to the lengths of the first and second engagement elements. In some embodiments, the inner pouch includes a plurality of pockets formed between the first and second sides, each pocket having an opening proximate to the open end of the inner pouch. An extension of the second face forms a flap with opposed ends and a lip, and the flap is applied over the open end of the inner pouch and the ends are secured to the first and second sides of the inner pouch on the first face of the inner pouch. The flap is adjustable between a first position, in which the lip is applied against the pockets between the openings of the pockets and the closed end of the inner pouch closing the openings of the pockets, and a second position, in which the lip is away from the pockets and the openings of the pockets are each accessible. The flap is biased into the first position.

According to the principle of the invention, a protective apparatus includes an outer pouch with a continuous sidewall formed with an inner layer and an outer layer, the outer pouch having an open end and an opposed closed end, and a flat, rectangular profile with opposed first and second sides extending between the open and closed ends. The apparatus also includes an inner pouch configured to nestle articles, which includes a continuous sidewall with an open end, an opposed closed end, opposed first and second sides, and a flat, rectangular profile with opposed first and second faces. The outer pouch is constructed of a material having a water-resistant and a fire-resistant material characteristic. The inner pouch is constructed of a fabric having an insulative material characteristic. A seam is formed in the outer layer of the outer pouch along the first side of the outer pouch between the open and closed ends of the outer pouch. A seam is formed in the inner layer of the outer pouch at a generally intermediate location between the first and second sides of the outer pouch and extending between the open and close ends of the outer pouch. A seam is formed along the first side of the inner pouch between the open and closed ends of the inner pouch. When the inner pouch is applied to the outer pouch such that the rectangular profile of the inner pouch is nested within the rectangular profile of the outer pouch, the seam in the inner layer of the outer pouch is offset from the seam in the outer layer of the outer pouch and from the seam in the inner pouch. The inner and outer pouches correspond in width. Opposed top and bottom faces are formed on the outer pouch, and an engagement assembly carried on the outer pouch. A first engagement element of the engagement assembly is carried on the top face of the outer pouch at a location intermediate with respect to the open and closed ends of the outer pouch, and a second engagement element of the engagement assembly is carried on the bottom face of the outer pouch proximate to the open end of the outer pouch. The outer pouch has a major length extending between the closed and open ends of the outer pouch, and has a minor length extending between the closed end of the outer pouch and the first engagement element of the engagement assembly. The inner pouch has a length extending between the closed and open ends of the inner pouch, and the length of the inner pouch corresponds to the minor length of the outer pouch. The first engagement element has a length aligned between the open and closed ends, and the second engagement element has a length aligned between the open and closed ends, which is equal to the length of the first engagement element. The first and second engagement elements are spaced apart by a distance equal to the lengths of the first and second engagement elements. In some embodiments, the inner pouch is applied permanently between the inner and outer layers of the outer pouch.

BRIEF DESCRIPTION OF THE DRAWINGS

Referring to the drawings.

DETAILED DESCRIPTION

Figure 1:
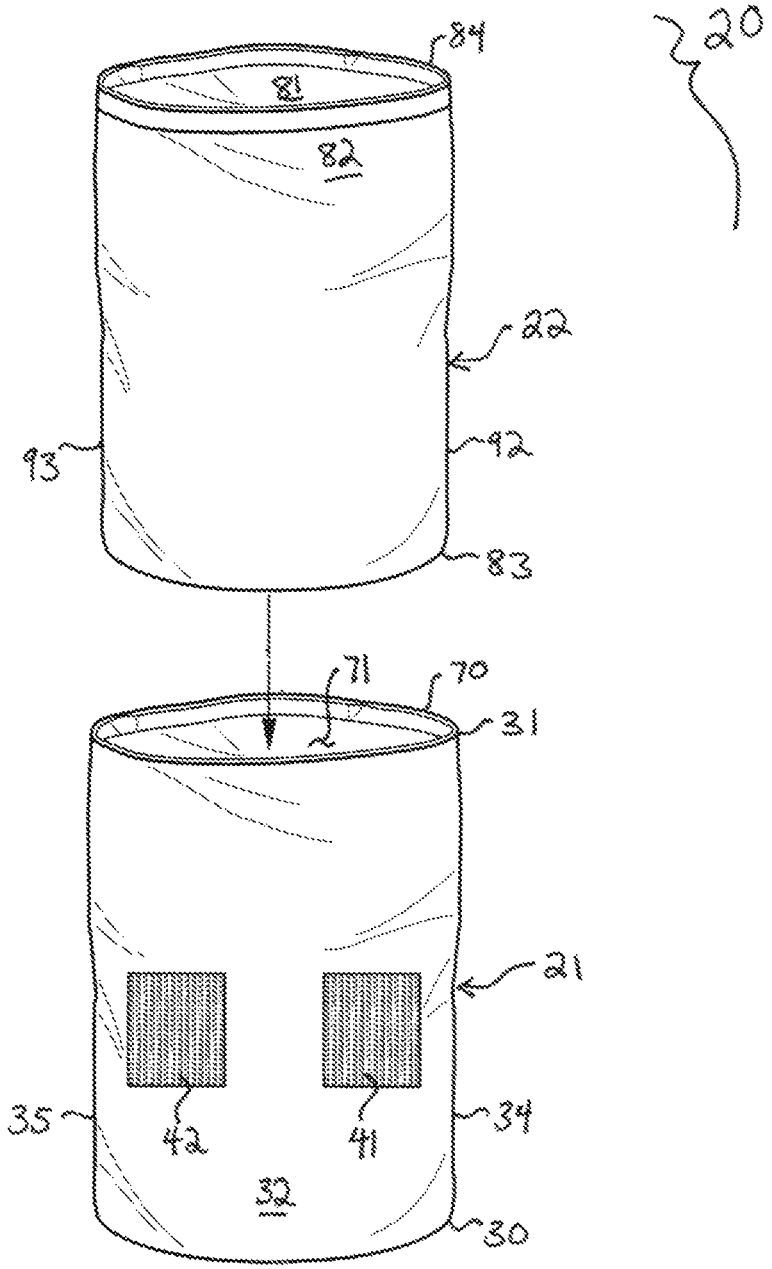
FIG. 1 is a view of the protective pouch apparatus showing an inner pouch removed from an outer pouch.

Reference now is made to the drawings, in which the same reference characters are used throughout the different figures to designate the same elements. FIG. 1 illustrates a protective pouch apparatus 20 for storing and protecting items for safekeeping, constructed and arranged in accordance with the principle of the invention. The apparatus 20 includes an outer pouch 21 and an inner pouch 22. The inner pouch 22 is removable from the outer pouch 21 and is applicable to the outer pouch 21 in a nested arrangement within the outer pouch 21. FIG. 1 shows the inner pouch 22 removed from the outer pouch 21 in a separated arrangement.

Figure 2A:
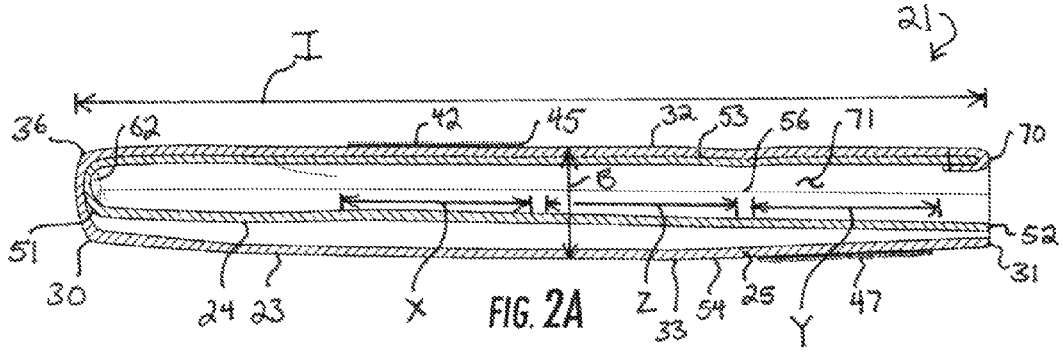
FIG. 2A is a section view of the outer pouch of FIG. 1 taken along the line 2-2 in FIG. 2B.
Figure 2B:
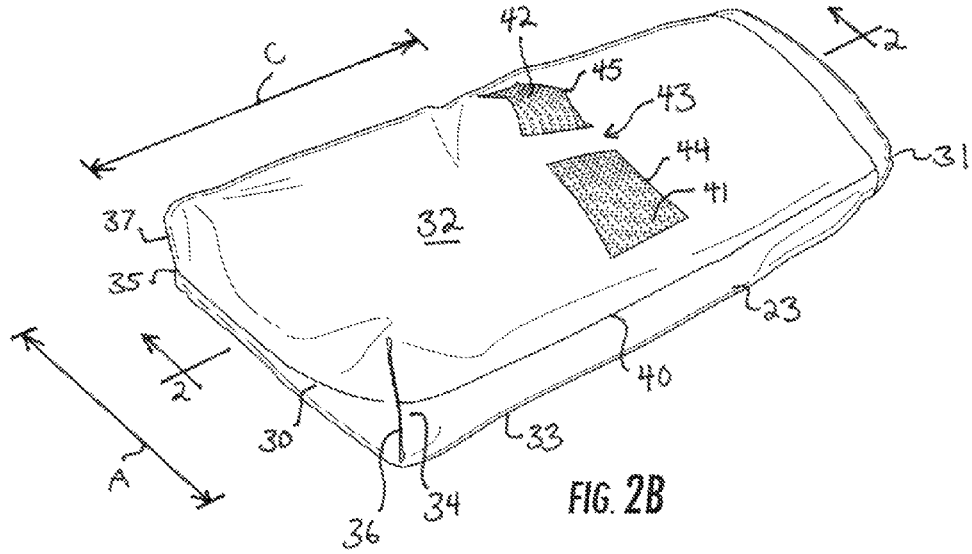
FIG. 2B is a top perspective view of the outer pouch of FIG. 1.
Figure 2C:
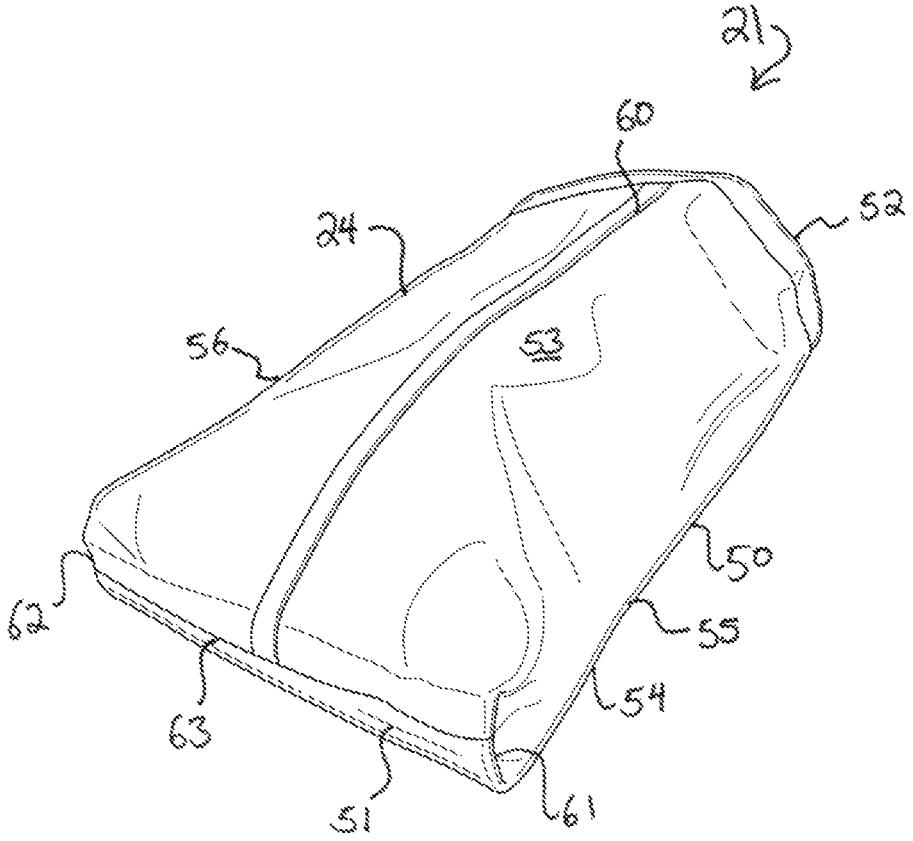
FIG. 2C is a top perspective view of the outer pouch of FIG. 1 turned inside-out.

FIGS. 2A, 2B, and 2C show the outer pouch 21 in greater detail. FIG. 2A illustrates a section view of the outer pouch 21 taken along the line 2-2 in FIG. 2B, and shows that the outer pouch 21 is constructed from two separate layers of materials; an outer layer 23 and an inner layer 24 which form continuous sidewalls of the apparatus 20. The outer layer 23 is a continuous sidewall 25 having a closed end 30 and an opposed open end 31. The sidewall 25 extends between the closed and open ends 30 and 31 and includes a top face 32, an opposed bottom face 33, and opposed sides 34 and 25. The top and bottom faces 32 and 33 are major faces and are broad, extending substantially across the entire outer layer 23, providing the outer layer 23 with a flat, rectangular profile. The top and bottom faces 22 and 23 are broad, coextensive, and generally parallel with respect to each other and perpendicular to each of the sides 34 and 35. The sides 34 and 35 are shallow, coextensive, and parallel with respect to each other. The closed end 30 of the outer layer 23 is shallow and perpendicular to the top face 32, the bottom face 33, and the sides 34 and 35.

FIG. 2B shows the pouch apparatus 20 from a top perspective view, and shows a seam 40 extending along the side 34 of the outer layer 23. The seam 40 joins the outer layer 23 outer layer 23 as a continuous band having ends that form the closed and open ends 30 and 31. The seam 40 extends along the side 34 from the open end 31 to the closed end 30, at a generally intermediate location on the side 34 with respect to the top face 32 and the bottom face 33 of the sidewall 25. The seam 40 is parallel with respect to the top and bottom faces 32 and 33, and as such, the sidewall 25 is provided with a width A between the sides 34 and 35 which is constant from the closed end 30 to the open end 31. The sidewall 25 also has a height B, which is clearly shown in FIG. 2A, between the top and bottom faces 32 and 33 which is constant from the closed end 30 to the open end 31. Two corners 36 and 37 are formed by seams in the closed end 30 of the sidewall 25 at the sides 34 and 35, respectively. The corners 36 and 37 extend between the top face 32 and bottom face 33 and provide rigidity to the closed end 30 of the sidewall 25, so that the outer layer 23 retains a generally flat pocket shape. In some embodiments according to the principle of the invention, the closed end 30 carries a rigid binding element or inflexible substrate to provide structural rigidity to the closed end 30 which resists flexing. In other embodiments according to the principle of the invention, the closed end 30 carries an elongate writing substrate for accepting writing marks thereon, such as a label, which provides both rigidity and a means of identifying items that are placed within the apparatus 20.

Still referring to FIG. 2B, the top face 32 of the outer layer 23 carries two engagement members 41 and 42. The engagement members 41 and 42 are disposed at an attachment location 43 on the top face 32 located intermediate with respect to the closed and open ends 30 and 31. The engagement members 41 and 42 are preferably of the hook-and-loop type, and are shown as such in FIG. 2B, and provide a means for securely closing the open end 31 and attaching the open end 31 to the top face 32 of the outer pouch 21. The engagement members 41 and 42 are two spaced-apart patches which are preferably sewn onto the outer layer 23 so as to join and secure the engagement members 41 and 42 to the outer layer 23. The engagement member 41 is proximate to the side 34, and the engagement member 42 is proximate to the side 35. The engagement members 41 and 42 have upper edges 43 and 44, respectively, directed toward the open end 31. The upper edges 43 and 44 of the engagement members 41 and 42 are a length C away from the closed end 30 of the outer layer 23. Length C is considered a minor length of the outer pouch 22 with respect to the major length I. In other embodiments, the engagement members 41 and 42 are some other type of fastener, such as a snap closure, magnet, slide fastener, or the like.

Figure 5A:
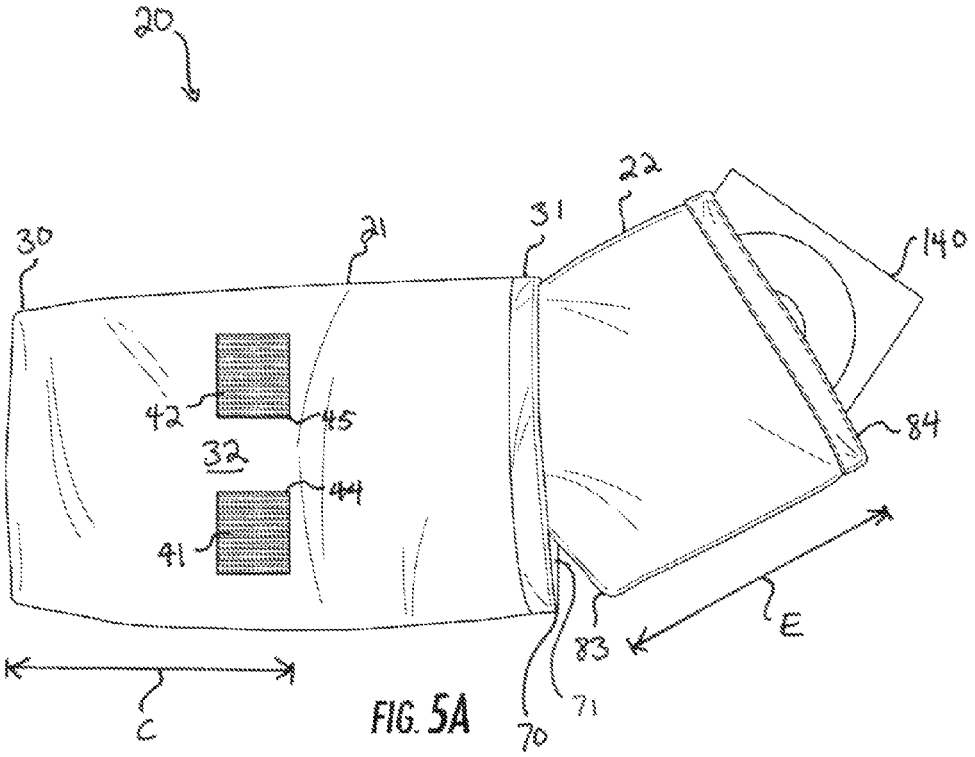
FIGS. 5A-5E are a series of sequential steps illustrating applying an article to the inner pouch, applying the inner pouch to the outer pouch, and closing and securing the outer pouch.
Figure 5B:
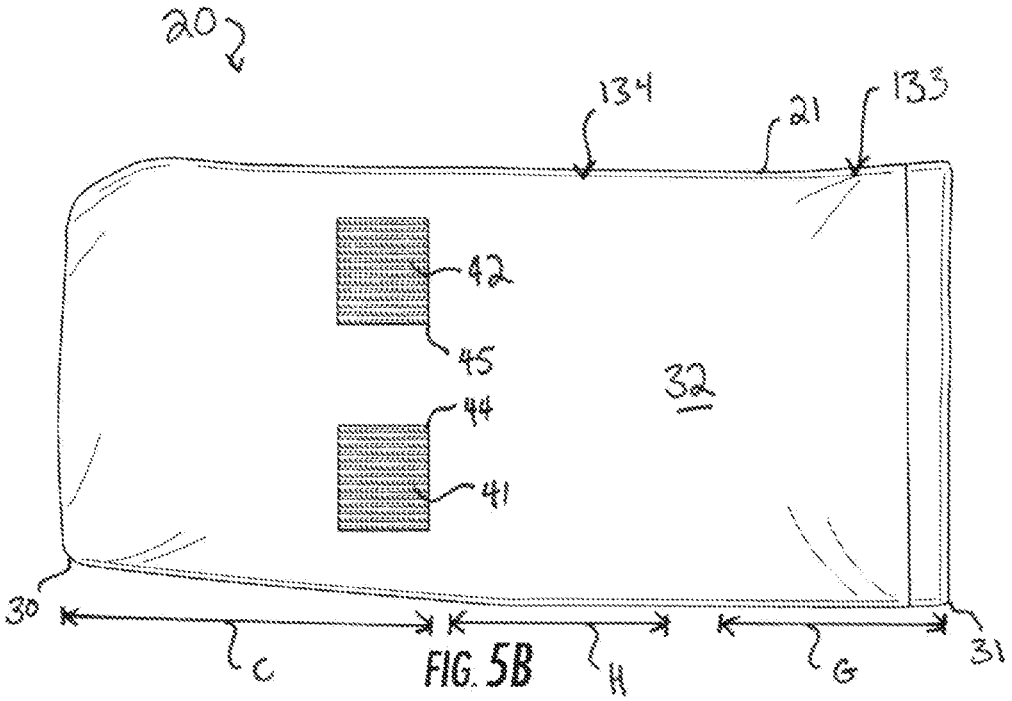
Figure 5C:
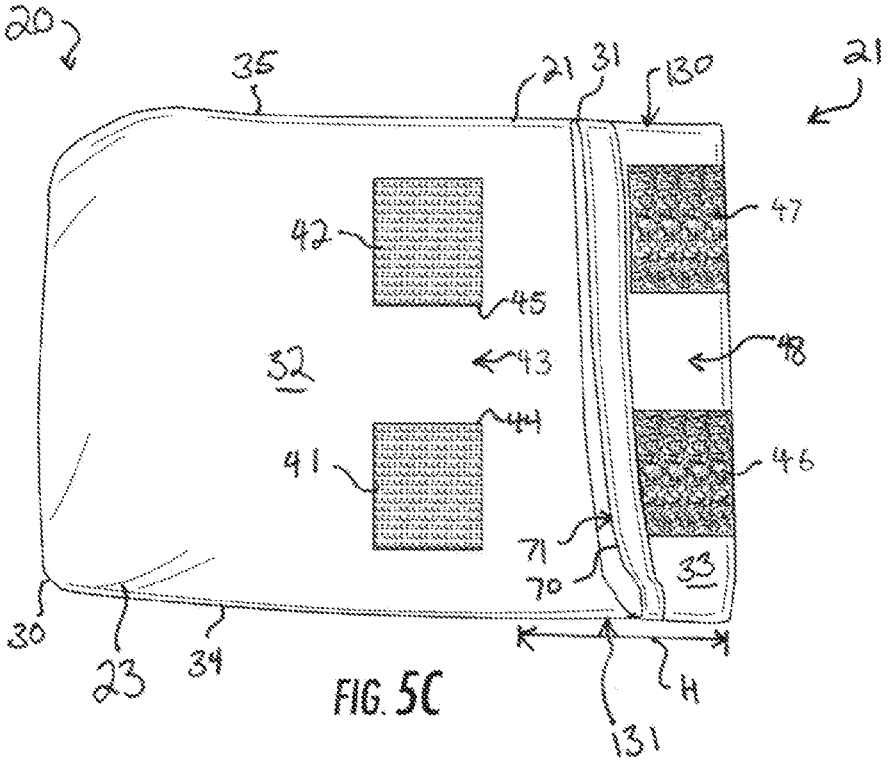

With reference briefly to FIG. 5C, which shows the outer pouch 21 in a partially folded arrangement, two spaced-apart engagement members 46 and 47 are applied to the bottom face 33 of the outer layer 23 proximate to the open end 31 at an attachment location 48 located generally intermediate with respect to the sides 34 and 35. The engagement members 46 and 47 are preferably sewn onto the outer layer 23 so as join and secure the engagement members 46 and 47 on the outer layer 23. The engagement member 46 is proximate to the side 34, and the engagement member 47 is proximate to the side 35. The engagement members 46 and 47, disposed on the bottom face 33, are complemental to and aligned with the engagement members 41 and 42 disposed on the top face 32. As such, the engagement member 46 and 47 are of the hook-and-loop type, and in embodiments in which the engagement members 41 and 42 are some other type of fastener, such as a snap closure, magnet, slide fastener, or the like, the engagement members 46 and 47 are also of the other type of fastener, such as a snap closure, magnet, slide fastener, or the like. The engagement members 46 and 47 releasably couple to the engagement members 41 and 42 when the apparatus 20 is in a folded arrangement.

The outer layer 23 is constructed from a material or combination of materials having material characteristics of high heat resistance, high flammability resistance, flexibility, low water absorption, and high tear strength, such as exemplary aramid and meta-aramid fabrics marketed under the brand names Nomex®, TenCate Defender™, or like materials. The thread constructing the seam 40 and securing the engagement members 41, 42, 46, and 47 to the outer layer 32 is also constructed from a material or combination of materials having material characteristics of high heat resistance, high flammability resistance, flexibility, and high tear strength, such as exemplary aramid and meta-aramid fabrics marketed under the brand name Nomex® or like materials. The engagement members 41, 42, 46, and 47 are still also constructed from a material or combination of materials having material characteristics of high heat resistance, high flammability resistance, flexibility, and high tear strength, such as exemplary aramid and meta-aramid fabrics marketed under the brand name Nomex® or like materials. The outer layer 23, constructed from such material or combination of materials, resists flame and will not ignite, melt, drip, or char with exposure to high temperatures, such as those up to between 500 and 700 degrees Fahrenheit (between 260 and 370 degrees Celsius), and the outer layer 23 will extinguish flame within approximately 2 seconds after exposure to flames of 1800 degrees Fahrenheit (980 degrees Celsius). The outer layer 23 protects the contents and articles within the apparatus 20 from heat and flame.

In some embodiments, the apparatus 20 includes handles aligned upwardly proximate to the open end 31. The handles are inverted, U-shaped loops formed of straps secured to the top and bottom face 32 and 33 just below the engagement members 41 ad 42, and 46 and 47, respectively.

FIG. 2C shows the apparatus 20 turned inside-out so as to display the inner layer 24 clearly. The inner layer 24 is constructed from a single sheet of material and is a continuous sidewall 50 having a closed end 51 and an opposed open end 52. The sidewall 50 extends between the closed and open ends 51 and 52 and includes a top face 53 and opposed bottom face 54, and sides 55 and 56. The top and bottom faces 53 and 54 are major faces and are broad, extending substantially across the entire inner layer 24, providing the inner layer 24 with a flat, rectangular profile. The top and bottom faces 53 and 54 are broad, coextensive, and generally parallel with respect to each other, and are perpendicular to each of the sides 55 and 56. The top and bottom faces 53 and 54 are coextensive with the top and bottom faces 32 and 33 of the outer layer 23. The sides 55 and 56 are shallow, coextensive, and parallel with respect to each other. The sides 55 and 56 are coextensive with respect to the sides 34 and 35 of the outer layer 23. The closed end 51 of the inner layer 24 is shallow and perpendicular to the top face 53, bottom face 54, and sides 55 and 56. The closed end 51 is coextensive with respect to the closed end 30 of the outer layer 23.

FIG. 2C illustrates the pouch apparatus 20 from a top perspective view, albeit in an inside-out arrangement, and shows a seam 60 extending along the top face 53 of the inner layer 24 from the closed end 51 to the open end 52 at a generally intermediate location with respect to the sides 55 and 56. The seam 60 joins the outer layer 23 as a continuous band having ends that form the closed and open ends 51 and 52. The seam 60 on the inner layer 24 is laterally offset from the seam 40 on the outer layer 23, as the seam 40 extends along the side 34 and the seam 60 extends between the sides 55 and 56.

The seam 60 is parallel with respect to the sides 55 and 56, and as such, the sidewall 50 has a constant width and height from the closed end 51 to the open end 52. Two corners 61 and 62 formed between the closed end 51 and the sides 55 and 56, respectively, fold inwardly into the apparatus 20. The corners 61 and 62 are secured to a seam 63 extending along the closed end 51 between the corners 61 and 62. The seam 60 is a major seam extending the length of the apparatus 20, while the seam 63 is a minor seam extending the width of the apparatus 20. The seams 60 and 63 are transverse with respect to each other, and the seam 60 is formed into the seam 63 at a generally intermediate location between the corner 61 and 62. The corners 61 and 62 are sewn into the seam 63 and folded inwardly into the inner layer 24 so as to form inwardly-directed corners. From the seam 63, the seam 60 extends upwardly to the open end 52. Each of these seams 60 and 63 is formed with a straight-stitch flat fell seam construction technique. To construct the inner layer 24, the sheet of material forming the outer layer is taken up by hand at peripheral edges. Opposed peripheral edges are taken together and are stitched along the length of the inner layer 24 just inboard of the peripheral edges, forming an elongated seam. One peripheral edge is then folder over the other and is sewn against the other to form the seam. The seam is folded down against the inner layer 24, and fire-resistant tape approximately 1.5 inches (approximately 3.8 centimeters) in width is then adhesively applied over the seam to form a water resistant and fire-resistant seam. Both seams 60 and 63 are formed with this construction technique, so that the inner layer 24 forms a substantially fluid impervious enclosure within the outer pouch 21 capable of resisting the transmission of water through the inner layer 24.

The inner layer 24 is a secondary moisture barrier. The inner layer 24 is preferably constructed from a material or combination of materials having material characteristics of high water resistance, flame resistance, and chemical resistance. The sheet is constructed with a two-layer construction including an outer moisture barrier laminated with a fire-resistant inner substrate. The sheet is constructed from materials such as those marketed under the exemplary Stedair® 3000 trademark. The inner layer 24, constructed from such materials, is fluid impervious and resists transmission of flame and water during prolonged exposure to flame and water. In the event that prolonged exposure allows flame and water to pass through the outer layer 23, the inner layer 24 protects the items in the apparatus 20 from flame and water penetration.

With reference back to FIG. 2A, the inner layer 24 is applied or nested within the outer layer 23. The outer and inner layers 23 and 24 are coextensive, having the same length between their closed ends 30 and 51 and open ends 31 and 52, respectively. As shown in FIG. 2A, each of the inner and outer layers 23 and 25 have a length I, which is considered a major length of outer pouch 20. The open ends 31 and 52 are sewn to each other to form a mouth 70 leading to a storage volume 71 bound by the inner layer 24. The outer layer 23 laps over the inner layer 24 at the mouth 70 to form a fire and water resistant barrier around the entrance to the storage volume 71. In some embodiments, the mouth 70 carries a fastening system, such as hook-and-loop engagement members, a slide fastener, snap closures, or the like, so that the mouth 70 may be repeatedly and quickly closed and opened. Fastening systems such as slide fasteners or snap closures are preferably constructed out of brass or other metal resistant to heat and flame. In alternate embodiments of the apparatus 20, an elongate sponge is applied to the mouth 70 and is directed inward into the opening of the mouth 70, providing an additional moisture barrier at the entrance to the storage volume 71. In the illustrated embodiment, however, the mouth is free of such structure. The storage volume 71 extends completely into the apparatus 20 to the closed end 51 of the inner layer 24. The closed end 51 of the inner layer 24 is disposed and received against the closed end 30 of the outer layer 23, and the corners 61 and 62 are received in the corners 36 and 37, respectively. The top face 53 of the inner layer 24 is received against the underside of the top face 32 of the outer layer 23, the bottom face 54 of the inner layer 24 is received against the top side of the bottom face 33 of the outer layer 23, and, although not easily shown in this view, the sides 55 and 56 of the inner layer 24 are received against the sides 34 and 35 of the outer layer 23, respectively, so as to define a close nesting arrangement of the inner layer 24 within the outer layer 23. Arranged and constructed in this way, the outer pouch 21 forms a double-layered fire, heat, and water protective enclosure for the storage volume 71. The seam 60 (shown in FIG. 2C) formed along the top face 53 of the inner layer 24 is offset from the seam 40 in the outer layer 23, so that any water that may intrude through the seam 40 cannot then penetrate the seam 60 along a direct line of transmission between the seams 40 and 60.

Figure 3:
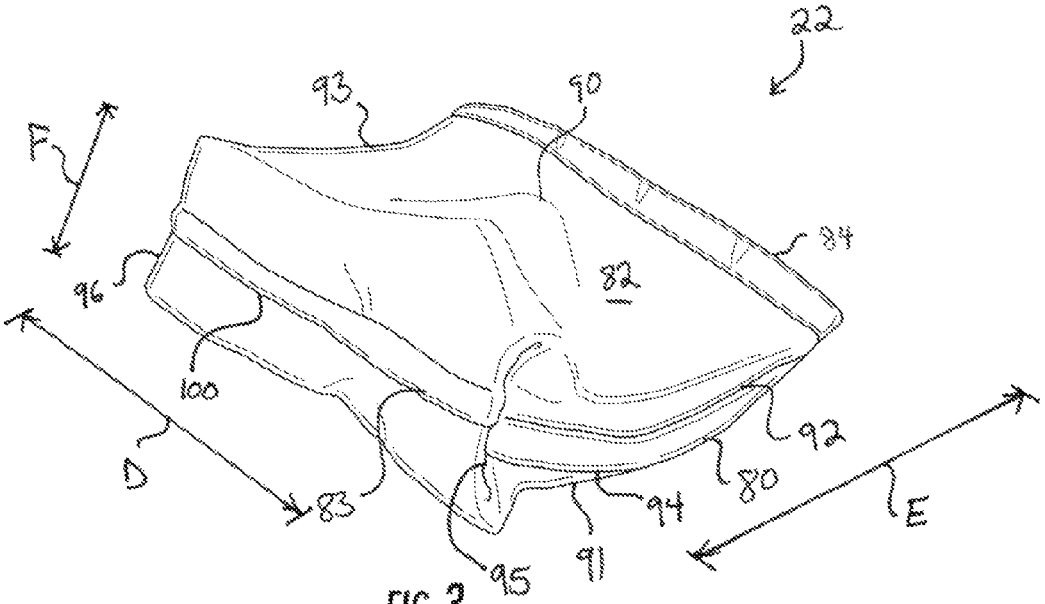
FIG. 3 is a top perspective view of the inner pouch of FIG. 1.

Removably received within the outer pouch 21, the inner pouch 22 receives and contains articles to be protected from water, fire, and heat damage. The inner pouch 22 is applied to the storage volume 71 during use of the apparatus 20. The inner pouch is shown in FIG. 3. The inner pouch 22 includes a closed sidewall 80 constructed from a dense, insulative material having an inner surface 81 (shown in FIG. 1) and an opposed outer surface 82. Referring still to FIG. 3, the inner pouch 22 has a closed end 83 and an opposed open end 84, and the sidewall 80 extends between the closed and open ends 83 and 84 and includes a top face 90, opposed bottom face 91, and sides 92 and 93. The top face 90 and bottom face 91 are broad, coextensive, and generally parallel with respect to each other and perpendicular to each of the sides 92 and 93. The top and bottom faces 91 each have a width D. The sides 92 and 93 are shallow, coextensive, and parallel with respect to each other. The sides 92 and 93 each have a length E. The length E is equal to the length C between the closed end 30 of the outer layer 23 and the upper edges 43 and 44 of the engagement members 41 and 42. The closed end 83 is shallow and perpendicular to the top face 90, bottom face 91, and sides 92 and 93. The closed end 83 has a height F.

Still referring to FIG. 3, the sidewall 80 is formed by a seam 94 joining the sidewall 80 as a continuous annular band. The seam 94 extends along the side 92 at a generally intermediate location with respect to the top face 90 and the bottom face 91 of the inner pouch 22. The seam 94 is parallel with respect to the top face 90 and bottom face 91, and as such, the width D and the height F of the inner pouch 22 are constant from the closed end 83 to the open end 84. Two corners 95 and 96 are formed by transverse seams on the closed end 83 at the sides 92 and 93, respectively. The corners 95 and 96 extend between the top and bottom 90 and 91 and provide rigidity to the closed end 83 of the inner pouch 22, so that the inner pouch 22 retains a generally flat pocket shape. A seam 100 extends along the closed end 83 at a generally intermediate location with respect to the top and bottom 90 and 91. The corners 95 and 96 are sewn into the seam 100 and are each folded inwardly so as to form inwardly-directed corners.

The inner surface 81 of the inner pouch 22 is a smooth, woven aramid or meta-aramid fabric. The outer surface 82 has a soft, lofty, fibrous batting characteristic. The loftiness of the outer surface 82 forms air pockets throughout which insulate the inner pouch 22. The inner pouch 22 is a thermal insulation layer and is preferably constructed from materials having the material characteristics of high heat resistance, high flame resistance, and high durability, such as exemplary aramid and meta-aramid fabrics marketed under the brand name TenCate Q-8™ or like materials. The inner pouch 22 protects the contents of the apparatus 20 from extreme heat. Articles are placed into the single storage volume within the inner pouch 22 by introducing the articles through the open end 84 and placing the articles within the inner pouch 22.

Figure 4A:
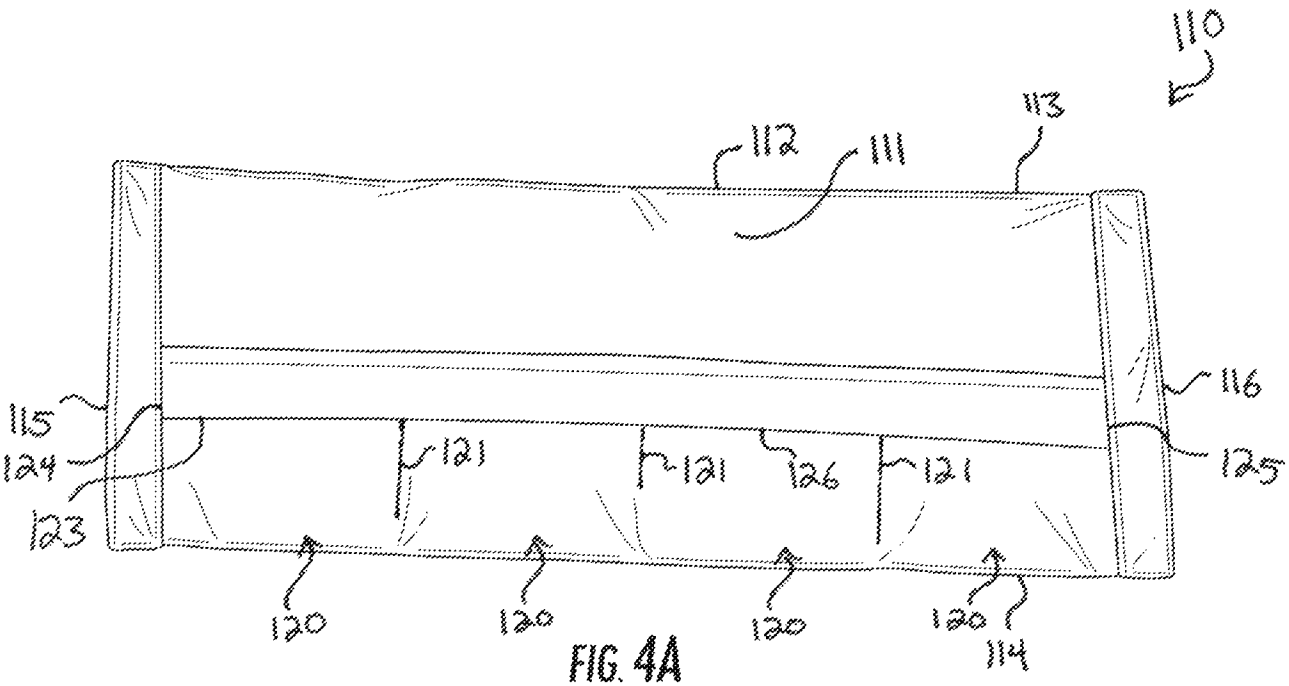
FIG. 4A is a front elevation view of an alternate embodiment of the inner pouch.
Figure 4B:
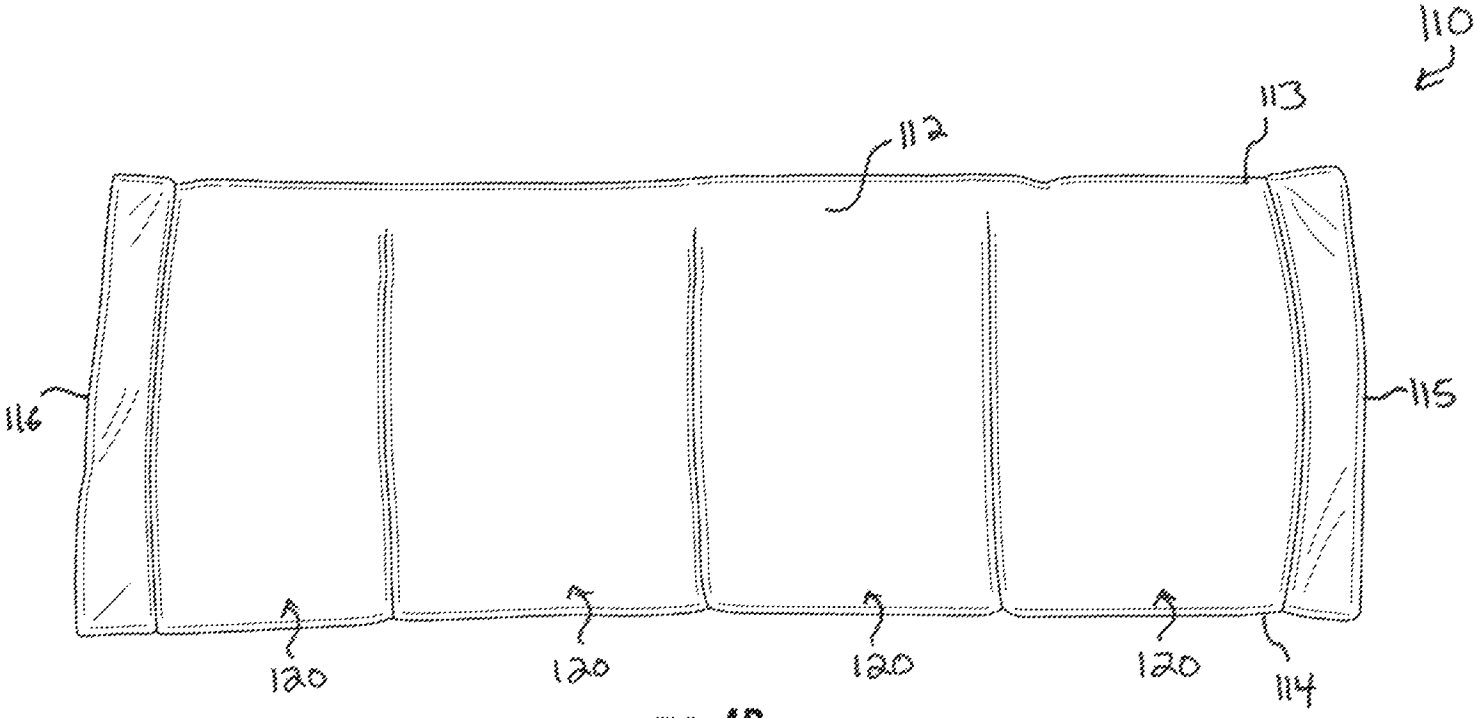
FIG. 4B is a rear elevation view of the inner pouch of FIG. 4A.
Figure 4C:
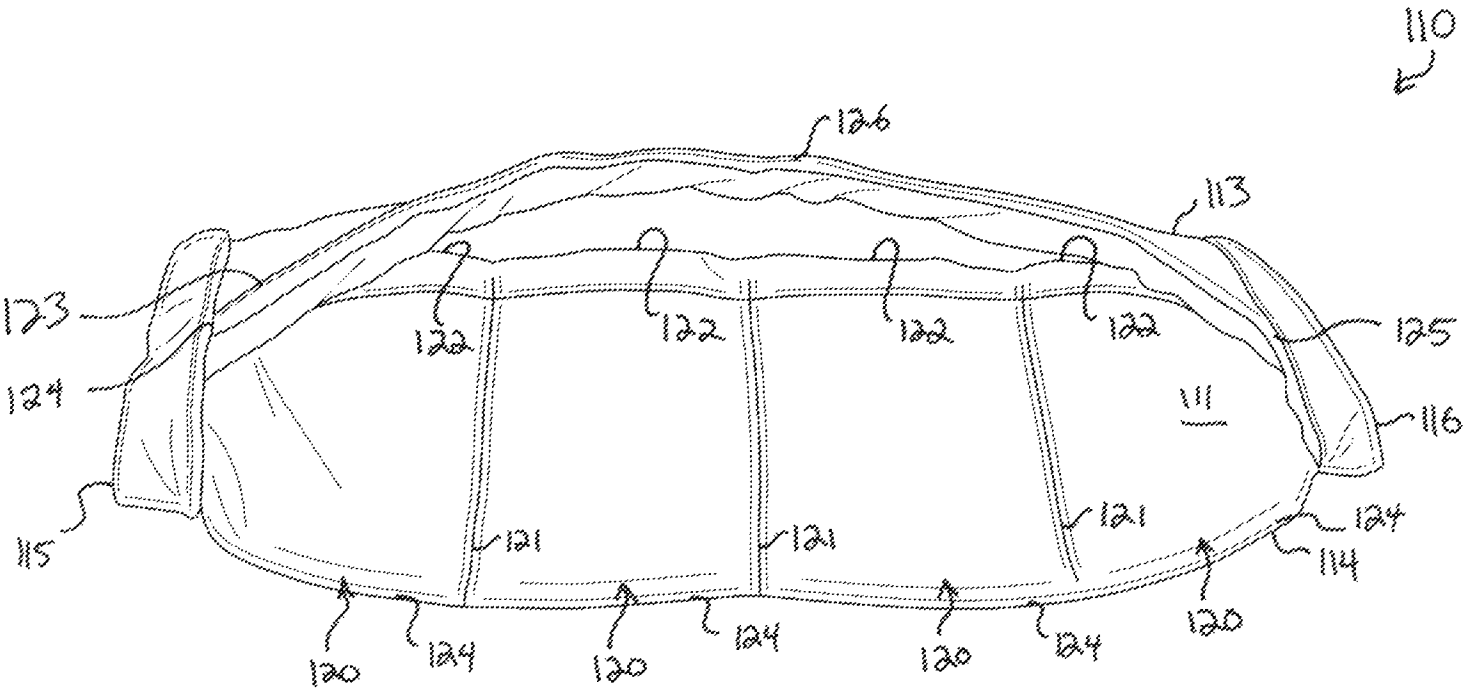
FIG. 4C is a bottom view of the inner pouch of FIG. 4A showing a flap of the inner pouch in an access condition providing access to pockets in the inner pouch.

FIGS. 4A-4C illustrate an alternate embodiment of the inner pouch, identified with the reference character 110. The inner pouch 110 is constructed from a single sheet of material and has a front 111 and back 112, a top 113 and bottom 114, and two sides 115 and 116. The sides 115 and 116 are sewn shut and define closed sides 115 and 116. The top 113 is an open end, and a flap 123 extends over the top 113 and down the front 111 toward the bottom 114 of the inner pouch 110, thereby closing the open end of the top 113. The flap 123 is an extension of the back 112 which lies partially over the front 111.

The inner pouch 110 includes four side-by-side, vertical pockets 120. The pockets 120 are formed in series between the ends 115 and 116 by vertical stitching 121 through the front 111 and back 112 of the inner pouch 110, delineating four separate spaces for storing small items. Referring now specifically to FIG. 4C, each of the pockets 120 extends between an opening 122 formed proximate to the open end of the top 113 of the inner pouch 110 and a bottom 123 formed along the bottom 114 of the inner pouch 110. The flap 123 lies over each of the pockets 120, covering the openings 122 and approximately half of the height of the pockets 120.

The flap 123 has opposed ends 124 and 125 and a lip 126 extending between the opposed ends 124 and 125. The ends 124 and 125 of the flap 123 are sewn and secured along the sides 115 and 116, respectively, approximately halfway between the top and bottom 113 and 114, so that the lip 126 is disposed approximately halfway down each of the pockets 120. The flap 123 is constructed of a flexible material, and is adjustable between an applied position in which the flap 123 and the lip 126 lie flat against the pockets 120 between the openings 122 and the bottoms 124 at the bottom 114 of the inner pouch 110, and an access position. In the applied position, the openings 122 of the pockets 120 are each closed by the flap 123, as shown in FIG. 4A. In the access position of the flap 123, as shown in FIG. 4C, the flap 123 and lip 126 are lifted off of the pockets 120, such as by taking up by hand, and each of the openings 122 are accessible. The flexible material of the flap 123, stretched between the ends 124 and 125 secured to the sides 115 and 116, biases the flap 123 flat against the pockets 120 into the applied position thereof.

Figure 5E:
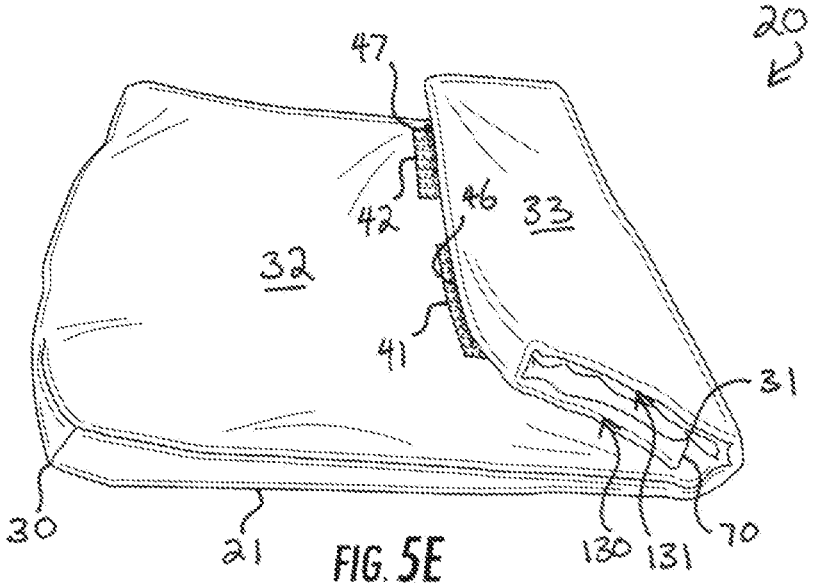
Figure 5D:
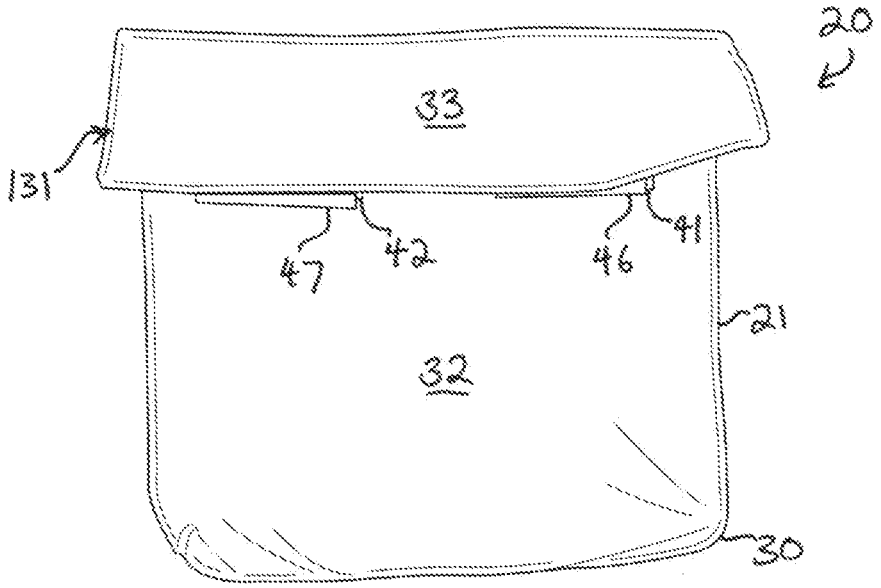

The inner pouch 110 is constructed of the same material as the inner pouch 22, and is useful for storing and protecting small items 124 such as portable USB memory drives and the like, as shown in FIG. 5D. To store an article or articles, the flap 123 is moved into the access position, in which the flap 123 is folded back, exposing the openings 122 of the pockets 120, and the article or articles are applied to the pockets 120. The flap 123 is then placed back over the openings 122 in the applied position, preventing the stored articles from coming loose from the pockets 120. Articles may be applied to a single pocket 120, or some or all of the pockets 120 may be used to store articles.

Figure 6:
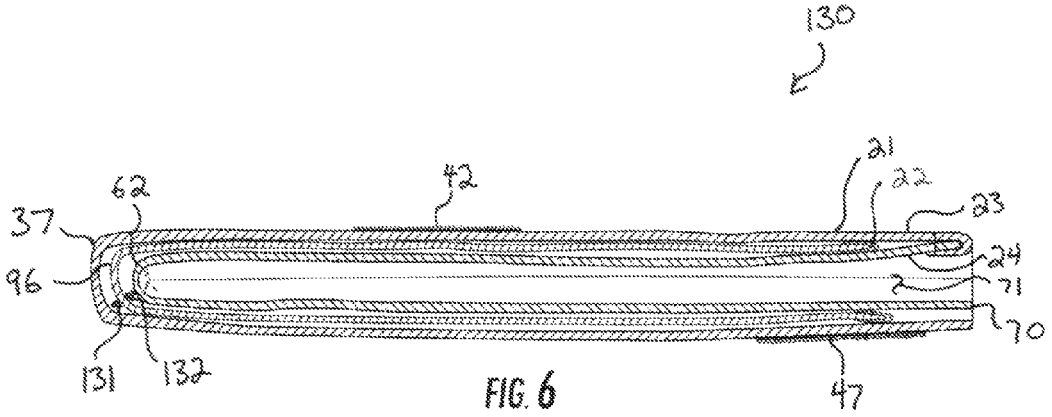
FIG. 6 is a section view similar to that of FIG. 2A showing an alternate embodiment of the protective pouch apparatus.

Referring briefly to FIG. 6, illustrated there is an alternate construction of the protective pouch apparatus, referenced as protective pouch apparatus 130. In this alternate construction, the inner pouch 22 is sewn into the outer pouch 21 between the outer and inner layers 23 and 24. In such an embodiment, the corners 95 and 96 are sewn to the corners 36 and 37 of the outer layer 23 and to the corners 61 and 62 of the inner layer 24, so as to form a single pouch having fire-resistant, thermal resistant, and water resistant properties. In this alternate embodiment, the inner layer 24 is formed with a bridge or tag 131 extending to and sewn to the outer layer 23, through the inner pouch 22. A hole 132 in the inner pouch 22 allows the tag 131 to be extended through the inner pouch 22 so that the inner layer 24 is secured to the outer layer 23. The hole 132 is sewn closed with the tag 131 through the hole 132. Moreover, the sewing closing the hole 132 is then seam-sealed with fire-resistant tape, forming a continuously bound enclosure. In this way, the inner layer 24 resists becoming separated from the outer layer 23 and from the inner pouch 22 when an article is removed from the storage volume 71.

The protective pouch apparatus 20 is suitable for a variety of safekeeping purposes. With reference back to FIG. 3, the inner pouch 22 is manufactured and useful in a variety of dimensions. In one embodiment, the width D is approximately 13 inches (33 cm) and the length E is approximately 13 inches (33 cm), so that the apparatus 20 is useful for storing and protecting scrapbooks containing photographs and other large keepsakes. In another embodiment, the width D is approximately 10.5 inches (27 cm), the length E is approximately 11.75 inches (30 cm), and the height F is approximately 1.5 inches (3.8 cm), so that the apparatus 20 is useful for storing and protecting baby books, antique or rare books, three-ring binders containing documents such as wills, birth certificates, passports, baseball cards, and the like. In still another embodiment, the width D is approximately 6.5 inches (16.5 cm), the length E is approximately 6.5 inches (16.5 cm), and the height F is approximately 2.5 inches (6.4 cm), so that the apparatus 20 is useful for storing and protecting compact disc and digital video discs in jewel cases. The inner pouch 110 has a width extending between the ends 115 and 116 of approximately 8 inches (20.3 cm) and has a length extending between the top 113 and bottom 114 of approximately 3.5 inches (8.9 cm).

FIGS. 5A through 5E illustrate the application and use of the apparatus 20. With reference first to FIG. 5A, to use the apparatus 20, an article 140 is first placed into the inner pouch 22 through the open end 84 of the inner pouch 22. The article 140 is placed completely within the inner pouch 22 against the closed end 83, so that no portion of the article 140 projects beyond the open end 84. The inner pouch 22 is then presented for application to the outer pouch 21. In some cases, as when the article 140 is smaller than the inner pouch 22, it may be preferable to fold the open end 84 of the inner pouch 22 over before application to the storage volume 71. The closed end 83 of the inner pouch 22 is applied to the mouth 70 at the open end 31 of the outer pouch 21 and the inner pouch 22 is then moved within the storage volume 71 until the closed end 83 of the inner pouch 22 is received against the closed ends 30 and 51 of the outer and inner layers 23 and 24 of the outer pouch 21, as arranged in FIG. 6C. In this arrangement of the inner pouch 22 applied to the outer pouch 21, the rectangular profile of the inner pouch 22 is closely nested within the rectangular profile of the outer pouch 21.

In FIG. 5B, the inner pouch 22 (no longer visible after application to the outer pouch 21) is nested within the storage volume 71 in the outer pouch 21. When the inner pouch 22 is within the outer pouch 21, the inner pouch 22 occupies the storage volume along the length C from between the closed end 30 of the outer layer 23 of the outer pouch 21 and the upper edges 44 and 45 of the engagement members 41 and 42. In this way, the length E of (shown in FIG. 5A) the inner pouch 22 corresponds to the length C of the outer pouch 21. A top portion 133 of the outer pouch 21, having a length G, and spaced apart from the upper edges 44 and 45 of the engagement elements 41 and 42 by an intermediate portion 134 having a length H approximately equal to G, is folded down over the top face 32 of the outer pouch 21 toward the closed end 30 to place the apparatus 20 in the arrangement shown in FIG. 5C with the engagement members 41 and 46 aligned with respect to each other and spaced apart by the distance H, and with the engagement members 42 and 47 aligned with respect to each other and spaced apart by the distance H. FIG. 5C shows the top portion 130 nearly folded down on top of the top face 32, so that the engagement members 46 and 47 are not quite separated by length H.

Briefly, FIG. 2A also shows the relative length and location of the engagement elements 41, 42, 46, and 47. The engagement elements 41 and 42 on the top face 32 have a length X aligned between the closed and open ends 30 and 31. The engagement elements 46 and 47, on the opposed bottom face 33, have a length Y aligned between the closed and open ends 30 and 31. The lengths X and Y are equal. Further, the engagement elements 41 and 42 are spaced apart from the engagement elements 46 and 47 by a length Z which is equal to the lengths X and Y.

Returning to FIGS. 5C and 5D, the top portion 130 and intermediate portion 131 are then folded together down over the top face 32 of the outer pouch 21 toward the closed end 30. The engagement members 41 and 46 engage with each other, and the engagement members 42 and 47 engage with each other, so as to couple the bottom face 33 of the outer pouch 21 along the top portion 130 against the top face 32 of the outer pouch 21 and under the intermediate portion 131, as shown in FIGS. 5D and 5E. In this way, the mouth 70 leading to the storage volume 71 is covered against the top face 32, cannot be accessed, and is protected from water intrusion by the intermediate portion 131. Further, the seam 94 on the inner pouch 22 is laterally offset from the seam 60 on the inner layer 24 of the outer pouch 21, which is laterally offset from the seam 40 on the outer layer 23 of the outer pouch 21. Therefore, there can be no direct linear transmission of water through the outer layer 23 of the outer pouch 21, the inner layer 23 of the outer pouch 21, and the inner pouch 22, because each of the seams 94, 60, and 40 is offset from the seam in the adjacent layer. The apparatus 20 can now protect the article 140 from exposure to heat, water, and flame without damage. The apparatus 20 is lightweight and only slightly larger than the article 140 contained within the storage volume 71, and as such, can be carried about easily. When a user desires to view the article 140 in the storage volume 71, the user nearly reverse the steps described above, by generally unfolding the top 31 of the outer pouch 21, opening the mouth 70, reaching into the storage volume 71, as by hand, and grabbing the inner pouch 22, pulling the inner pouch 22 out of the storage volume 71, and pulling the article 140 from within the inner pouch 22.

The above operation of the apparatus 20 has been described with respect to a fold-down operation of the open end 31 of the outer pouch 21. In an alternate operation of the apparatus 20, the open end 31 is rolled toward the closed end 30 of the outer pouch 21. In this operation, the apparatus 20 has an alternate construction in which the engagement members 46 and 47 are applied to the bottom face 33 of the outer layer 23 at the intermediate portion 131. In this way, as the open end 31 is rolled toward the closed end 30, the engagement members 46 and 47 are rolled onto the engagement members 41 and 42.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

The invention claimed is:

1. A protective apparatus consisting of:

an outer pouch including a continuous sidewall formed of two flexible layers, the outer pouch having an open end with a continuous mouth and an opposed closed end, a flat, rectangular profile with opposed first and second sides extending between the open and closed ends, and an inner surface of the continuous sidewall bounding and defining a storage volume within the outer pouch;

an inner pouch removably applied to the storage volume of the outer pouch, the inner pouch configured to nestle articles, and the inner pouch including a continuous sidewall with an open end with a continuous mouth, an opposed closed end, opposed first and second sides, and a flat, rectangular profile with opposed first and second faces;

the outer pouch is constructed of a material having a water-resistant characteristic and a fire-resistant characteristic;

the inner pouch is constructed of a fabric having an insulative characteristic;

opposed first and second faces on the outer pouch;

an engagement assembly carried on the outer pouch;

a first engagement element of the engagement assembly carried on the first face of the outer pouch at a location intermediate with respect to the open and closed ends of the outer pouch; and a complemental second engagement element of the engagement assembly carried on the second face of the outer pouch proximate to the open end of the outer pouch;

a seam in the sidewall of the outer pouch; and a seam in the sidewall of the inner pouch;

wherein when the inner pouch is applied to the storage volume of the outer pouch such that the rectangular profile of the inner pouch corresponds to the rectangular profile of the outer pouch and is nested within the storage volume of the outer pouch, the seam in the inner pouch is offset from the seam in the outer pouch, and the continuous mouth of the inner pouch is below the continuous mouth of the outer pouch, defining a portion of the outer pouch which extends above the continuous mouth of the inner pouch.

2. A protective apparatus consisting of:

an outer pouch including a continuous sidewall formed of two flexible layers, the outer pouch having an open end with a continuous mouth and an opposed closed end, a flat, rectangular profile with opposed top and bottom faces extending between the open and closed ends and between opposed first and second sides, and an inner surface of the continuous sidewall bounding and defining a storage volume within the outer pouch;

an inner pouch removably applied to the storage volume of the outer pouch, the inner pouch configured to nestle articles, and the inner pouch including a continuous sidewall with an open end, an opposed closed end with a continuous mouth, opposed first and second sides, and a flat, rectangular profile with opposed first and second faces;

the outer pouch is constructed of a material having a water-resistant characteristic and a fire-resistant characteristic;

the inner pouch is constructed of a fabric having an insulative characteristic and corresponds in width to the outer pouch;

a seam formed along the top face of the outer pouch between the open and closed ends of the outer pouch; and a seam formed along the first side of the inner pouch between the open and closed ends of the inner pouch;

wherein when the inner pouch is applied to the storage volume of the outer pouch such that the rectangular profile of the inner pouch corresponds to the rectangular profile of the outer pouch and is nested within the storage volume of the outer pouch, the seam in the inner pouch is offset from the seam in the outer pouch, and the continuous mouth of the inner pouch is below the continuous mouth of the outer pouch, defining a portion of the outer pouch which extends above the continuous mouth of the inner pouch.

3. A protective apparatus consisting of:

an outer pouch including a continuous sidewall formed with an inner layer and an outer layer, the outer pouch having an open end with a continuous mouth and an opposed closed end, a flat, rectangular profile with opposed first and second sides extending between the open and closed ends, and an inner surface of the continuous sidewall bounding and defining a storage volume within the outer pouch;

an inner pouch, the inner pouch configured to nestle articles, and including a continuous sidewall with an open end with a continuous mouth, an opposed closed end, opposed first and second sides, and a flat, rectangular profile with opposed first and second faces;

the outer pouch is constructed of a material having a water-resistant characteristic and a fire-resistant characteristic;

the inner pouch is constructed of a fabric having an insulative characteristic;

a seam formed in the outer layer of the outer pouch along the first side of the outer pouch between the open and closed ends of the outer pouch;

a seam formed in the inner layer of the outer pouch at a generally intermediate location between the first and second sides of the outer pouch and extending between the open and close ends of the outer pouch; and a seam formed along the first side of the inner pouch between the open and closed ends of the inner pouch;

wherein when the inner pouch is removably applied to the storage volume of the outer pouch such that the rectangular profile of the inner pouch corresponds to the rectangular profile of the outer pouch, the seam in the inner layer of the outer pouch is offset from the seam in the outer layer of the outer pouch and from the seam in the inner pouch, and the continuous mouth of the inner pouch is below the continuous mouth of the outer pouch, defining a portion of the outer pouch which extends above the continuous mouth of the inner pouch.

* * * * *